US005470224A

United States Patent [19]

Bortz

[11] Patent Number: 5,470,224

[45] Date of Patent: Nov. 28, 1995

[54] APPARATUS AND METHOD FOR REDUCING $NO_X$, CO AND HYDROCARBON EMISSIONS WHEN BURNING GASEOUS FUELS

[75] Inventor: Steven J. Bortz, Laguna Niguel, Calif.

[73] Assignee: Radian Corporation, Austin, Tex.

[21] Appl. No.: 233,358

[22] Filed: Apr. 26, 1994

Related U.S. Application Data

[63] Continuation-in-part of Ser. No. 92,979, Jul. 16, 1993, abandoned, and Ser. No. 188,586, Jan. 27, 1994, Pat. No. 5,407,347.

[51] Int. Cl.[6] ..... F23C 5/08

[52] U.S. Cl. ..... 431/182; 431/116; 431/183; 431/174

[58] Field of Search ..... 431/9, 10, 10.4, 431/181, 115, 116, 284, 285, 187, 159, 174, 175–178

[56] References Cited

U.S. PATENT DOCUMENTS

| | | | |
|---|---|---|---|
| 3,115,924 | 12/1963 | Massier . | |
| 3,227,202 | 1/1966 | Morgan . | |
| 3,358,736 | 12/1967 | Reed et al. . | |
| 3,749,548 | 7/1973 | Zink et al. . | |
| 3,775,039 | 11/1973 | Pillard . | |
| 3,788,065 | 1/1974 | Markowski . | |
| 3,811,277 | 5/1974 | Markowski . | |
| 3,890,084 | 6/1975 | Voorheis | 431/178 |
| 4,083,674 | 4/1978 | Holzapfel . | |
| 4,094,625 | 6/1978 | Wang et al. . | |
| 4,130,389 | 12/1978 | Kaburagi et al. . | |
| 4,155,701 | 5/1979 | Primas . | |
| 4,160,640 | 7/1979 | Maev et al. . | |
| 4,221,558 | 9/1980 | Santisi . | |
| 4,230,445 | 10/1980 | Janssen . | |
| 4,297,093 | 10/1981 | Morimoto et al. . | |
| 4,451,230 | 5/1984 | Bocci et al. . | |
| 4,479,775 | 10/1984 | Wiesel . | |
| 4,496,306 | 1/1985 | Okigami et al. | 431/174 |
| 4,505,666 | 3/1985 | Martin et al. | 431/175 |
| 4,600,377 | 7/1986 | Musil . | |
| 4,701,124 | 10/1987 | Maghon et al. . | |
| 4,842,509 | 6/1989 | Hasenack . | |
| 4,884,555 | 12/1989 | Huang . | |
| 4,899,670 | 2/1990 | Hansel . | |
| 4,943,230 | 7/1990 | Shekleton . | |
| 5,000,679 | 3/1991 | Fukuda et al. . | |
| 5,009,174 | 4/1991 | Polak . | |
| 5,029,557 | 7/1991 | Korenberg . | |
| 5,062,792 | 11/1991 | Maghon . | |
| 5,085,577 | 2/1992 | Muller . | |
| 5,092,762 | 3/1992 | Yang . | |
| 5,101,633 | 4/1992 | Keller et al. . | |
| 5,135,387 | 8/1992 | Martin et al. . | |
| 5,147,199 | 9/1992 | Perthuis et al. . | |

(List continued on next page.)

FOREIGN PATENT DOCUMENTS

| | | | |
|---|---|---|---|
| 0193838 | 9/1986 | European Pat. Off. . | |
| 0393484 | 10/1990 | European Pat. Off. . | |
| 4203598C1 | 6/1993 | Germany . | |
| 14228 | 2/1977 | Japan | 431/174 |
| 2252400 | 8/1992 | United Kingdom . | |
| WO92/19913 | 11/1992 | WIPO . | |

*Primary Examiner*—James C. Yeung
*Attorney, Agent, or Firm*—Klauber & Jackson

[57] ABSTRACT

A two stage rapid mix burner provides apparatus and method which significantly reduce the burner size of a rapid mix burner, and/or the burner pressure drop, while maintaining the rapid mix feature and stability of the basic rapid mix design. The burner can also be easily altered to fit in non-circular geometries, such as a corner or tangential fired boiler. The invention uses a circular basic rapid mix burner located internally of a larger burner which can be non-circular. The inner burner provides the flow of hot gases which stabilizes the outer burner. In effect, the combustion gases produced in the inner burner replace the strong internal recirculation flow generated by the basic RMB as an ignition source for the outer burner flow.

22 Claims, 12 Drawing Sheets

U.S. PATENT DOCUMENTS 5,161,946 11/1992 Bortz et al. .
5,169,304 12/1992 Flament et al. .
5,186,607 2/1993 Yang et al. .
5,192,204 3/1993 Musil .
5,240,410 8/1993 Yang et al. .
5,269,678 12/1993 Schwartz ..... 431/116
5,269,679 12/1993 Syska et al. ..... 431/115

APPARATUS AND METHOD FOR REDUCING $NO_X$, CO AND HYDROCARBON EMISSIONS WHEN BURNING GASEOUS FUELS

RELATED APPLICATION

This application is a continuation-in-part of my applications Ser. Nos. 08/092,979, abandoned and 08/188,586, U.S. Pat. No. 5,407,347 filed respectively on Jul. 16, 1993, and Jan. 27, 1994, and assigned to the assignee of the present application.

FIELD OF THE INVENTION

This invention relates generally to combustion apparatus, and more specifically relates to a burner that combines the advantageous operating characteristics of nozzle mix and premixed type burners to achieve extremely low $NO_x$, CO and hydrocarbon emissions.

BACKGROUND OF THE INVENTION $NO_x$ emissions from gas flames can be created either through the Zeldevitch mechanism (often called thermal $NO_x$) or through the formation of HCN and/or $NH_3$ which can then be ultimately oxidized to $NO_x$ (prompt $NO_x$). Thermodynamic calculations typically show that $NO_x$ emissions measured from natural gas flames are well below, one to two orders of magnitude, the thermodynamic equilibrium value. This indicates that in most situations $NO_x$ formation is kinetically controlled.

Kinetic calculations indicate that thermal $NO_x$ emissions are typically the most important source of $NO_x$ for natural gas flames, with the $NO_x$ being created through the following reactions:

$$N+O_2=NO+O \quad (1)$$

$$N+OH=NO+H \quad (2)$$

$$N_2+O=NO+N \quad (3)$$

Kinetic calculations were performed using a PC version of the CHEMKIN computer program. Calculations using this program have provided valuable insight into changes in the burner fuel and air mixing characteristics which can lower $NO_x$ emissions.

As the name implies, thermal $NO_x$ can be controlled by regulation of the peak flame temperature, and as shown in FIG. 1 using kinetic calculations, if the temperature can be lowered enough the $NO_x$ emissions from a "true" premixed natural gas flame operating at 15% excess air can be reduced to extremely low values (less than 1 ppmv). In effect FIG. 1 shows the relationship between thermal $NO_x$ and temperature since for a premixed natural gas flame with an excess of oxygen, thermal $NO_x$ is the only route by which any significant $NO_x$ emissions are created.

Under appropriate flame conditions the formation of prompt $NO_x$ can also be important when burning natural gas. The kinetic model used shows that under fuel rich conditions, particularly when the stoichiometry is under about 0.6, both HCN and $NH_3$ can be formed through reaction of CH with $N_2$ to form HCN and N. These calculations were conducted using gas and air mixtures with stoichiometries ranging from 1.0 to 0.4. The model predicts that prompt $NO_x$ becomes important at higher stoichiometries when the temperature is lower; see FIG. 2. Below a stoichiometry of 0.5 almost all the $NO_x$ formed is prompt $NO_x$. The rate of prompt $NO_x$ formation (as the name implies) is also very rapid, being nearly complete in about 1 millisecond at a temperature of 2400° F.

Kinetic calculations also indicate that hydrocarbon fragments, in addition to being important for prompt $NO_x$, are also important for thermal $NO_x$ formation since they can act as a source of O atoms and OH radicals. Kinetic calculations show the importance of the hydrocarbon concentration in the formation of $NO_x$, even under oxidizing conditions. At a temperature of 3400° F. the predicted $NO_x$ emissions were about 4 ppmv after 5 ms residence time for a mixture of $N_2$, $O_2$, $H_2O$, and $CO_2$ when hydrocarbons were not present, as compared to 80 ppmv when combustion of about 1% $CH_4$ was present in the gas mixture. If the concentration of methane initially present was reduced to about 0.5%, the $NO_x$ concentration after 5 ms was reduced to about 75 ppmv. The kinetic model used predicts that the following mechanisms are important:

1. Reaction of $CH_4$ with $O_2$, OH and H to form $CH_3$
2. Reaction of $CH_3$ with $O_2$ to form $CH_3O$ and O
3. Reaction of $N_2$ with O to form NO and O
4. Various reactions to form OH
5. Reaction of $N_2$ with OH to form NO and NH Low $NO_x$ gas burners have been undergoing considerable development in recent years as governmental regulations have required burner manufacturers to comply with lower and lower $NO_x$ limits. Most of the existing low $NO_x$ gas burner designs are nozzle mix designs. In this approach the fuel is mixed with the air immediately downstream of the burner throat. These designs attempt to reduce $NO_x$ emissions by delaying the fuel and air mixing through some form of either air staging or fuel staging combined with flue gas recirculation ("FGR"). Delayed mixing can be effective in reducing both flame temperature and oxygen availability and consequently in providing a degree of thermal $NO_x$ control. However, delayed mixing burners are not effective in reducing prompt $NO_x$ emissions and can actually exacerbate prompt $NO_x$ emissions. Delayed mixing burners can also lead to increased emissions of CO and total hydrocarbons. Stability problems often exist with delayed mixing burners which limit the amount of FGR which can be injected into the flame zone. Typical FGR levels at which current burners operate are at a ratio of around 20% recirculated flue gas relative to the total stack gas flow.

A further type of low $NO_x$ burner which has been developed in recent years is the premixed type burner. In this approach, the fuel gas and oxidant gases are mixed well upstream of the burner throat, e.g. at or prior to the windbox. These burners can be effective in reducing both thermal and prompt $NO_x$ emissions. However, problems with premixed type burners include difficulty in applying high air preheat, concerns about flashback and explosions, and difficulties in applying the concept to duel fuel burners. Premix burners also typically have stability problems at high FGR rates.

In the inventions of my Ser. Nos. 092,979 and 188,586 applications (the disclosures of which are hereby incorporated by reference) extremely low $NO_x$, CO and hydrocarbon emissions are achieved, while maintaining the desirable features of a nozzle mix burner. This is accomplished by injecting the fuel gas, such as natural gas, in a position that would be typical for a nozzle mix burner, while generating such rapid mixing that, effectively, premixed conditions are created upstream of the ignition point.

In such burner apparatus an outer shell is provided which includes a windbox and a constricted tubular section in fluid communication therewith. A generally cylindrical body is mounted in the shell, coaxially with and spaced inwardly from the tubular section so that an annular flow channel or throat is defined between the body and the inner wall of the tubular section. Oxidant gases are flowed under pressure from the windbox to the throat, and exit from a downstream outlet end. A divergent quarl is adjoined to the outlet end of the throat and define a combustion zone for the burner. A plurality of curved axial swirl vanes are mounted in the annular flow channel to impart swirl to the oxidant gases flowing downstream in the throat. Fuel gas injector means are provided in the annular flow channel proximate or contiguous to the swirl vanes for injecting the fuel gas into the flow of oxidant gases at a point upstream of the outlet end. The fuel gas injection means comprise a plurality of spaced gas injectors, each being defined by a gas ejection hole and means to feed the gas thereto. The ratio of the number of gas ejection holes to the projected (i.e. transverse cross-sectional) area of the annular flow channel which is fed fuel gas by the injector means is at least $200/ft^2$.

One or more turbulence enhancing means may optionally be mounted in the throat at at least one of the upstream or downstream sides of the swirl vanes. These serve to induce fine scale turbulence into the flow to promote microscale mixing of the oxidant and fuel gases prior to combustion at the quarl.

The gas injectors can be located at the leading or trailing edges of the swirl vanes, and inject the fuel gas in the direction of the tangential component of the flow imparted by the swirl vanes. The gas injectors can also be disposed on a plurality of hollow concentric rings which are mounted in the throat downstream of the swirl vanes. The injectors can similarly comprise openings disposed in opposed concentric bands on the walls which define the inner and outer radii of the annular flow channel. The gas injectors can also be located at the surfaces of the swirl vanes, with the vanes being hollow structures fed by a suitable manifold. Preferably the geometry of the burner is such that the product of the swirl number S and the quarl outlet to inlet diameter ratio C/B is in the range of 1.0 to 3.0.

Pursuant to another aspect of the Ser. No. 092,979 and Ser. No. 188,586 invention, a method is provided for injection of gaseous fuel in a forced draft burner of the type which includes an annular throat of outer diameter B, having an inlet connected to receive a forced flow of air and recirculated flue gases, and an outlet adjoined to a divergent quarl. The gaseous fuel is injected at an axial coordinate which is spaced less than B in the upstream direction from the axial coordinate at which the quarl divergence begins; and sufficient mixing of the gaseous fuel with the air and recirculated flue gases is provided that these components are well-mixed down to a molecular scale at the axial coordinate of ignition. This procedure results in extremely low $NO_x$, CO and hydrocarbon emissions from the burner.

In a further aspect of the Ser. No. 092,979 and Ser. No. 188,586 invention, the swirl vanes, which are mounted with their leading edges parallel to the axial flow of fuel and oxidant gases, and then slowly curve to the final desired angle, have a constant radius of curvature along the curved portion of the vane, whereby the curved portion is a section of a cylinder. This shape simplifies manufacturing using conventional metal fabricating techniques.

Additional background which will be helpful in understanding the present invention can be gained by reviewing FIGS. 3, 4, 5 and 6 herein, which describe a representative embodiment of the apparatus disclosed in my prior applications. In FIG. 3 an isometric perspective view thus appears of such prior art embodiment of burner apparatus 51. This Figure may be considered simultaneously with FIGS. 4, 5 and 6, which are respectively longitudinal cross-sectional; and front and rear end views of apparatus 51.

In burner apparatus 51 combustion air (which can be mixed with recirculated flue gas) is provided to the windbox 53 through a cylindrical conduit 55. Windbox 53 adjoins a tubular section 57 which terminates at a flange 59, which is secured to a divergent quarl 58 (FIG. 12). In the arrangement shown, the inner co-axial cylindrical body 61 is comprised of a central hollow cylindrical tube 63 intended for receipt of an oil gun or a sight glass, and a surrounding tubular member or cylinder 65 which is spaced from the outside wall of tube 63 and closed at each end, by closures 67. A hollow annular space 68 is thereby formed between tubular member 63 and cylinder 65, which serves as a manifold 68 for the fuel gas which is provided to such space via connector 69. The cylindrical body 61 is positioned and spaced within wind box 53 and tubular section 61 by passing through flanges, one of which is seen at 71. The latter is secured to a plate 73 at the end of the wind box by bolts 75 and suitable fasteners (not shown). This arrangement enables easy disassembly, as for servicing and the like.

In the arrangement of burner 51, a series of swirl vanes 77 are provided in the annular space or throat 79 which is defined between tubular body 61 (specifically, between the outer wall of cylinder 65) and the inner wall of tubular member 57.) At the immediately upstream end of each of the swirl vanes 77, gas injector means are provided which take the form of a plurality of tubes 81, each of which is provided with multiple holes 83. It will be evident that the tubes 81, being hollow members, are in communication at their open one end with the interior of the gas manifold 68 defined within member 65, which therefore serves as a feed source for the fuel gas. The fuel gas is discharged in the direction of the openings 83, so that in each instance fuel is injected into the throat directly at the leading edges of the swirl vanes and in the direction of the tangential component of the flow imparted by the swirl vanes 77. Accordingly, the gas injection also acts to enhance the swirl number of the flow.

Although the invention of my Ser. Nos. 092,979 and 188,586 applications (hereinafter at times referred to as the "basic rapid mix burner" or "basic RMB") is extremely effective in achieving the desired results, the basic RMB design results in a burner size that is significantly larger than many existing burners. Although the large burner size is not inherently important to the rapid mix feature, the large burner size is important for creating an extremely stable flame which allows high flue gas recirculation rates to be used without concerns about the flame becoming unstable.

Another limitation of the basic RMB design is that the burner geometry must be kept circular. This is clearly a limitation in a boiler or furnace that use square, rectangular or other shape burners.

When the basic RMB is retrofit into existing furnaces, the larger size, relative to the existing burner, can create significant difficulties and increase the retrofit cost. Problems with the larger burner size are particularly apparent when the boiler or furnace burner wall is a "water wall" consisting of pressurized steam or water tubes. For this type design the burner openings are made by bending the boiler tubes. Any significant increase in the burner size entails bending new tubes to make a larger opening. Utility and large field erected industrial boilers typically have the burners inserted through a water wall.

One method of reducing the burner size is to increase the velocities through the burner. However this method has the disadvantage of increasing the pressure drop through the burner. A higher pressure drop through the burner creates other retrofit difficulties, including replacement of forced draft fans, increased operating costs associated with the higher fan pressure, structural limitations on the windbox and increased operating costs.

SUMMARY OF INVENTION

Now in accordance with the present invention, a two stage rapid mix burner design provides apparatus and method which both significantly reduces the burner size of a rapid mix burner, and/or the burner pressure drop, while maintaining the rapid mix feature and stability of the basic rapid mix design. The two stage rapid mix burner design of the invention can also be easily altered to fit in non-circular geometries, such as a corner or tangential fired boiler.

The present invention uses a circular basic rapid mix burner (i.e. as in my earlier applications), located internally inside a larger burner which can be non-circular. The inner burner provides the flow of hot gases which stabilizes the outer burner. In effect, the combustion gases produced in the inner burner replace the strong internal recirculation flow generated by the basic RMB as an ignition source for the outer burner flow. The inner burner uses the same type swirler, burner and quarl geometry as the basic RMB burner described in my previous applications and consequently has the desired stability and $NO_x$, CO and HC performance. The outer portion of the burner uses a rapid mix injection grid and consequently also has the desired $NO_x$, CO and HC performance. Since the flame stability is provided by the inner burner, swirl vanes or a divergent quarl for the outer portion of the burner are not required.

The inner burner is circular with a cylindrical tube mounted in the center defining an annular space between the outer and inner tubes. A plurality of curved fixed axial vanes are mounted in the annular space to impart swirl to the oxidant gases flowing through the burner. The number of vanes varies linearly with the burner diameter. The typical spacing between vanes, on the inner annulus is approximately one inch. Fuel injection means are provided in the annular flow channel proximate or contiguous to the swirl vanes for injecting the fuel gas into the flow of oxidant gases. The fuel gas injection means comprises a plurality of spaced gas injectors, each defined by a gas injection hole and a means to feed the gas thereto. The ratio of the number of gas injection holes to the projected area of the annular flow channel which is fed fuel gas by the injector means is at least $200/ft^2$. A divergent quarl is adjoined to the outlet end of the inner burner and defines a combustion zone for the burner. The purpose of the quarl is to both promote strong internal recirculation within the inner burner and to provide enough residence time to allow the stability of the flame from the inner burner to be relatively unaffected by the outer portion of the burner. Consequently, a quarl length/inlet diameter ratio of at least 1.75 is desired.

The gas injectors for the inner burner can be located at the leading or trailing edges of the swirl vanes, and inject the fuel in the direction of the tangential component and/or opposite to the direction of the tangential velocity component of the flow imparted by the swirl vanes. The gas injectors can also be disposed on a plurality of hollow concentric rings which are mounted in the throat downstream of the swirl vanes. The injected gas can similarly comprise openings disposed in opposed concentric bands on the walls which define the inner and outer radii of the annular flow channel. The gas injectors can also be located at the surfaces of the swirl vanes, with the vanes being hollow structures fed by a suitable manifold. Details of these arrangements are shown in my Ser. Nos. 092,979 and 188,586 applications.

The inner burner is enclosed by a second annular space or number of outer burners cells for which the inner burner acts as an ignition source. The air to the outer burner annulus or regions can be fed from either a separate windbox or from a windbox common to both the inner and outer burner. The two most common geometries for the outer burner are an annular space concentric to the inner burner or a rectangular region with the inner burner diameter less than or equal to the smaller dimension of the rectangular opening. However the basic two stage RMB concept can function with outer burner geometries of any shape.

Inside the region defined by the oxidant flow of the outer burner, rapid mix gas injectors are positioned to provide rapid mixing between the oxidant and fuel. The gas injectors can take the shape of radial spuds fed from either a outer or inner manifold. The spuds are drilled with holes to provide the desired mixing rate between fuel and oxidant. The gas injection spuds can also take the shape of concentric rings, horizontal or vertical grids or other shapes compatible with the outer burner geometry. Typically the spacing between gas injection spuds is approximately one inch with the spacing between the holes drilled into the spuds being in the range 0.2 to 0.4 inches. The spacing of the fuel gas injection holes provides uniform gas distribution within the oxidant. The cross-sectional area of each gas spud is at least 3 times the total area of the injection holes in each spud, to provide adequate gas distribution to each hole. Typically, if the number of holes in each spud is greater than 4, ¼ inch diameter cylindrical tubing is preferably not used for the injection spuds. Instead either "racetrack" oval tubing, airfoil tubing or fabricated injectors having a maximum width, in a plane defined by the cross-sectional area of the burner throat, of ¼ inch and a length, normal to the same plane, determined by the required cross-sectional area and wall thickness of the tube. The "flattened" faces of these tubes are thus the surfaces at which the ejector holes are present, and thus the direction of gas ejection is generally tangential to a radius drawn to the hole, and in a plane or planes transverse to the axis of the burner.

As an example of a typical injector design, an injection spud may have a height of 3 inches with an average hole spacing of 0.25 inch (resulting in 12 holes). Using 1/16 inch holes, the total injection area would be 0.0368 square inches per spud. If tubing with a 0.035 inch wall is used, and the tube minor axis is 0.25 inch, a length for the major axis of the tube of at least 0.625 inches would be required to maintain a inlet area for the spud of at least 3 times the injection area.

The ratio of the number of gas injection holes to the projected cross-sectional area of the annular flow channel is at least $200/ft^2$. The diameter of the holes is determined by the same criteria as discussed in my prior pending applications.

Means may be provided to enhance the mixing of the gas and oxidant in the outer portion of the burner. These means may include the use of screens or perforated plates which induce fine scale turbulence into the flow, or axial swirl vanes may be used in the outer flow to both induce mixing and to control the flame shape.

The heat input ratio between the inner and outer burners is typically in the range of 5% to 20% when the burner is operated at maximum capacity. In one mode of operation the heat input to the inner portion of the burner would remain fixed and, if a lower heat input is required, the fuel and oxidant rate would be decreased in the outer burner only. In the extreme case the burner could be operated with fuel input to the inner portion of the burner only, in which case the burner would operate as a standard RMB. However, if desired, the thermal inputs of the inner and outer burner could be controlled together. In this mode the inner and outer burner would be controlled so that the heat input from both burner portions would vary linearly; i.e. if the total input is 50% both the inner and outer burners would operate at 50% of maximum input.

Typically, recirculated flue gas (FGR) is added to the combustion air of both the inner and outer burner. The FGR is added far enough upstream of the burner to result in premixed air and FGR at the gas injection point. As an alternative to FGR, air or another inert can be used to reduce the flame temperature. The amount of FGR used is dependent on the desired $NO_x$ level.

As also disclosed in my said Ser. Nos. 092,979 and 188,586 applications, an oil gun can be inserted through the center, along the axis of the inner burner, to provide backup oil burning capability. When operated on oil, the swirl vanes and quarl of the inner burner will provide the necessary flame stability. All the oil will be injected through the center of the burner, providing the delayed fuel and air mixing (internal staging) necessary for $NO_x$ control with oils which contain a significant amount of fuel nitrogen.

BRIEF DESCRIPTION OF DRAWINGS

The invention is diagrammatically illustrated, by way of example, in the drawings appended hereto in which.

DESCRIPTION OF PREFERRED EMBODIMENTS

Figure 1:
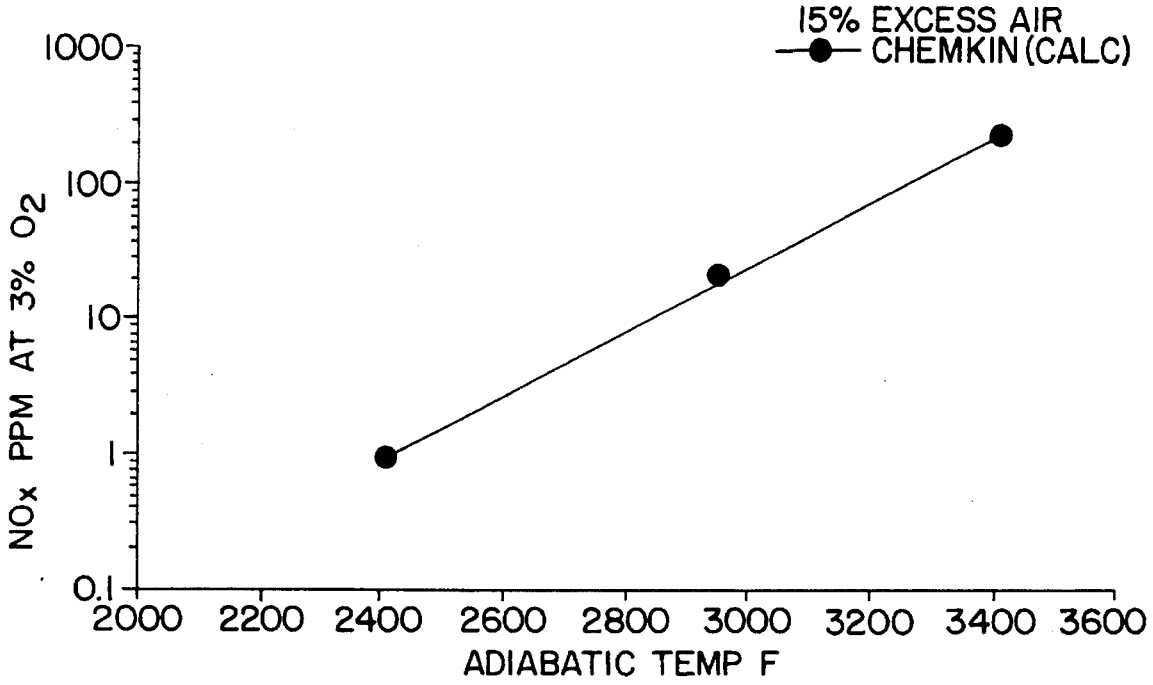
FIG. 1 is a graphical depiction showing calculated $NO_x$ versus adiabatic flame temperature for a premixed flame with 15% excess air.
Figure 2:
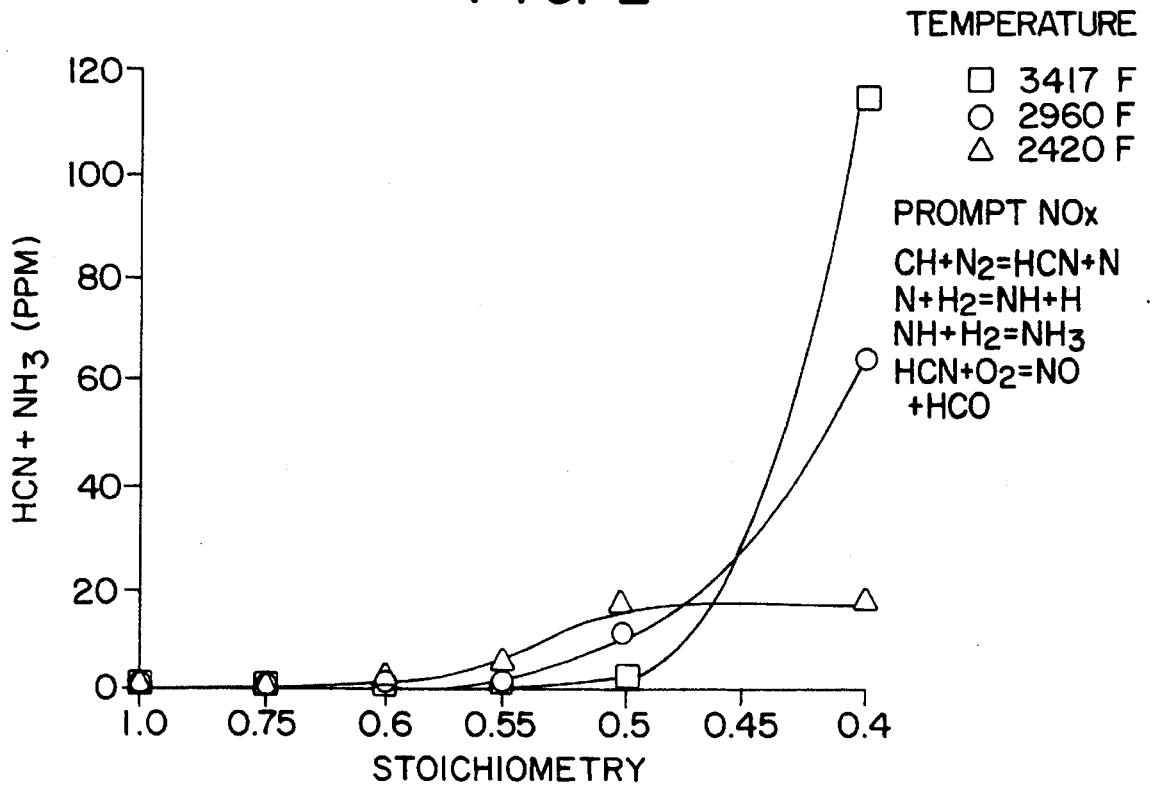
FIG. 2 is a further graph showing kinetic calculation of prompt $NO_x$ (HCN and $NH_3$)
Figure 3:
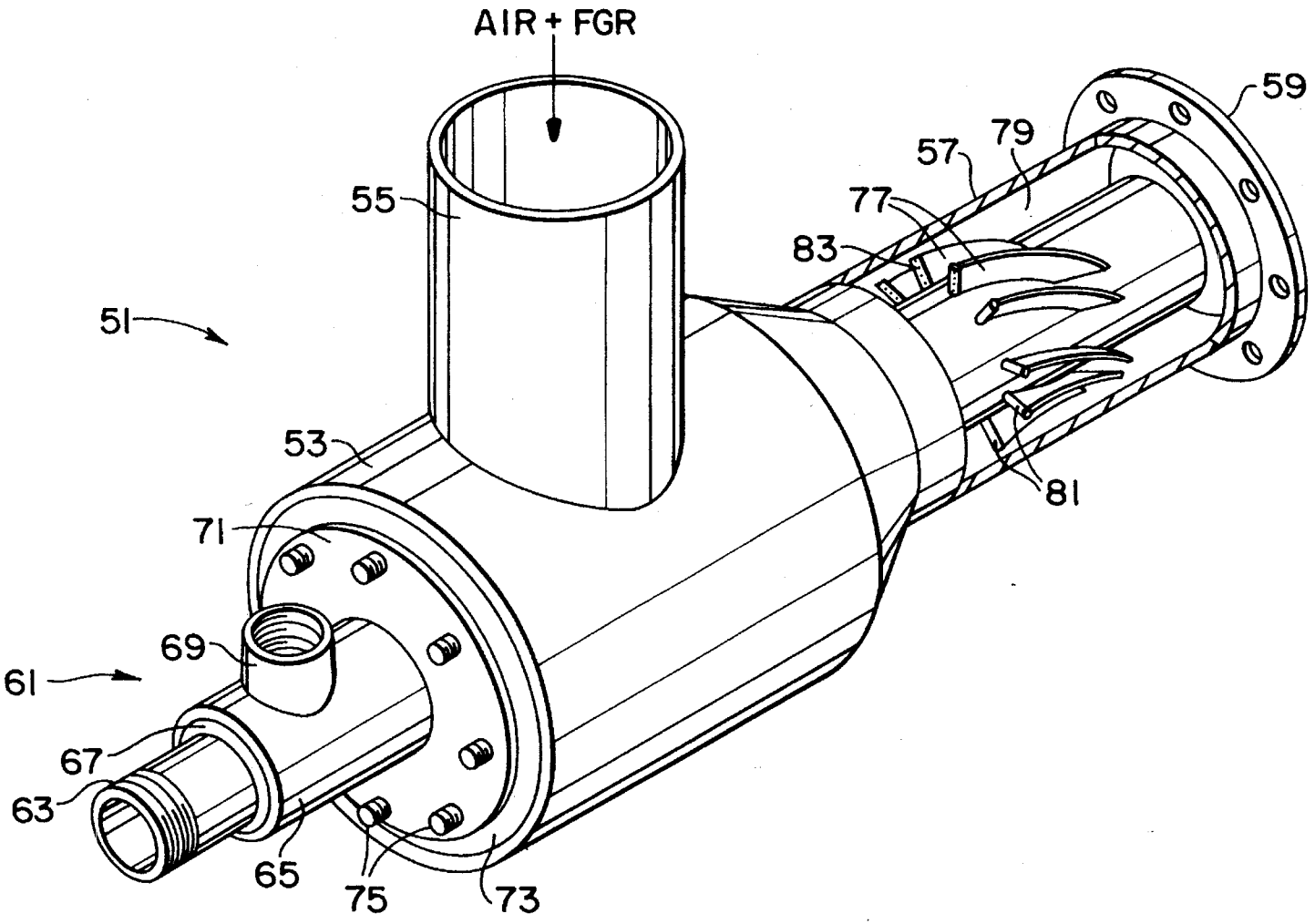
FIG. 3 PRIOR ART
In FIG. 3 a perspective view appears of an embodiment of prior art burner apparatus in accordance with the disclosure of my Ser. Nos. 092,979 and 188,586 applications.
Figure 5:
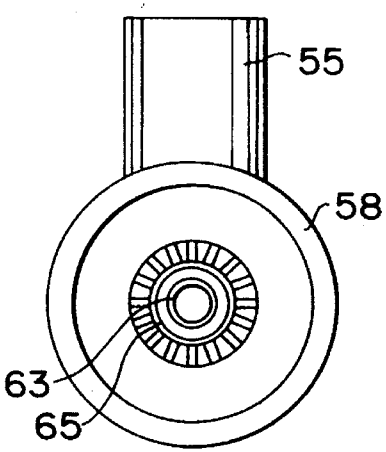
FIG. 5 PRIOR ART
FIGS. 5 and 6 are respectively front and rear-end views of the apparatus of FIGS. 3 and 4.
Figure 4:
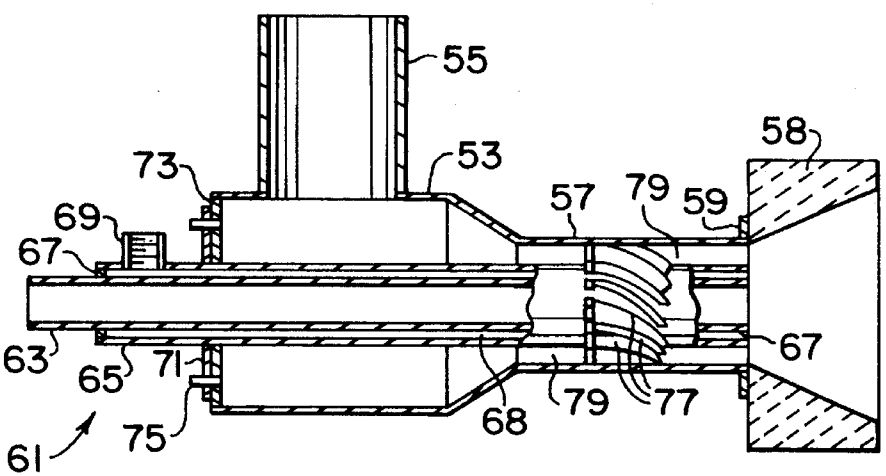
FIG. 4 PRIOR ART
FIG. 4 is a longitudinal cross-sectional view through the apparatus of FIG. 3.
Figure 6:
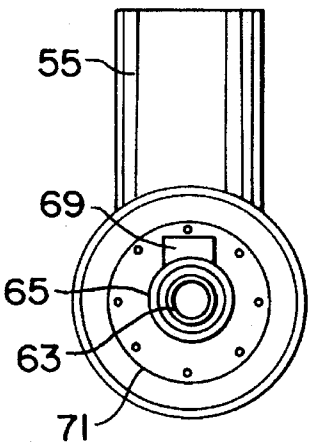
FIG. 6 PRIOR ART
Figure 7:
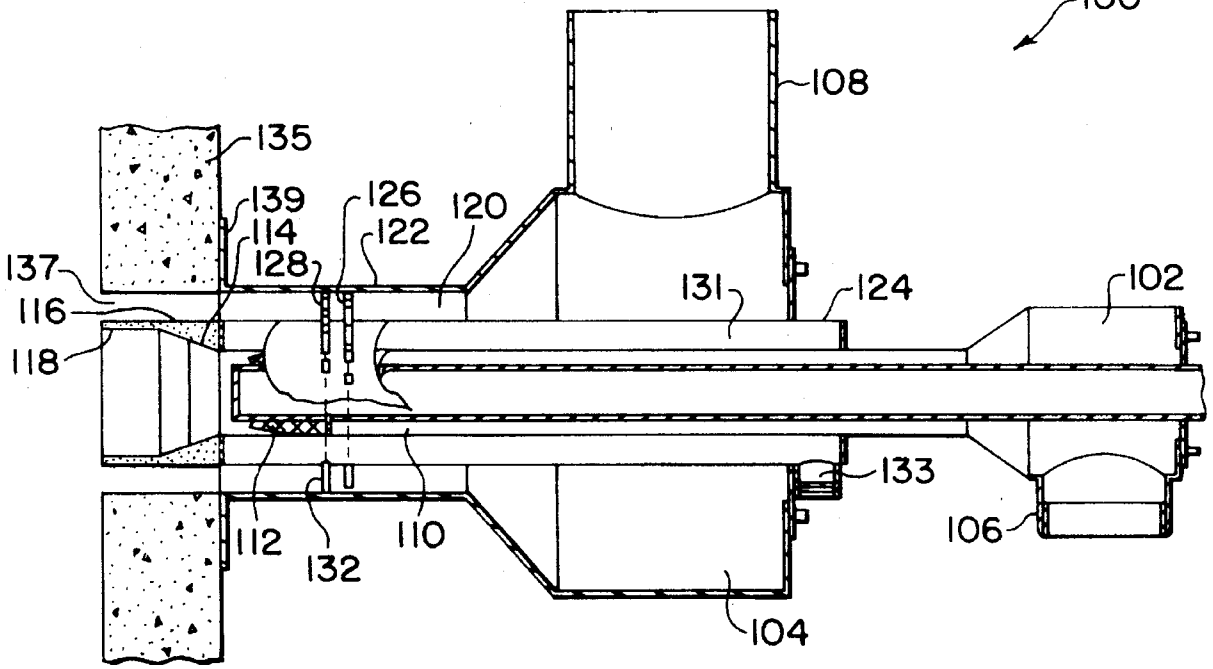
FIG. 7 is a longitudinal cross-sectional view, through a first embodiment of apparatus in accordance with the present invention.
Figure 8:
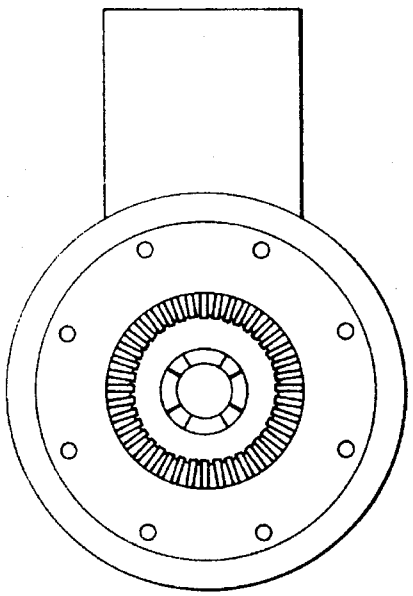
FIG. 8 is a front end view of the FIG. 7 apparatus.

FIGS. 7 and 8 respectively depict a longitudinal cross-sectional and front end view of a two stage circular RMB 100 in accordance with the present invention. This arrangement employs separate windboxes 102 and 104 for the inner and outer portions of the burner. Air and FGR (recirculated flue gas) are provided under positive pressure by conventional fan means (not shown) via ducts 106 and 108 to both windboxes.

The air and flue gas mixture proceed through the inner burner throat 110 to the swirl vanes 112. The design of the swirl vanes and gas injectors correspond to the disclosure of my prior applications. At the leading edge of the swirl vanes, gas is injected in the same direction as the curvature of the swirl vanes, this arrangement being similar to that shown in FIGS. 3 through 6. The air, gas, flue gas mixture then passes through the swirl vanes resulting in a well mixed composition at the beginning of the quarl divergence 114. Ignition of the mixture occurs early in the quarl 116 and, at the axial position corresponding to the quarl exit, a significant amount of the fuel is combusted. The ignited gases proceed to a combustion chamber which in use is adjoined to the burner at the quarl exit.

The geometrical design of the inner burner is consistent with the design of the basic RMB—see e.g. FIGS. 3 to 6. The dimensions of the annular region defined by the ratio of the inner diameter of the swirl vanes divided by the outer diameter of the swirl vanes, is preferably in the range of 0.6 to 0.8. In addition, the product of the swirl number with the quarl outlet to inlet ratio is preferably in the range 1.0 to 3.0.

In order to help isolate the flame of the inner burner from the fluids in the outer portion of the burner, the quarl exit angle 118 would typically be zero degrees. However quarl exit angles ranging from either greater (diverging at the exit) or less than zero degrees (converging at the exit) may be desirable for some applications. To provide adequate residence time within the quarl for the inner burner, the quarl length/quarl inlet diameter ratio should be a minimum of 1.75.

The air and flue gas mixture comprising the oxidant is also fed into the windbox 104 that supplies the outer burner. This oxidant stream is fed into the annular flow region or channel 120 between the outer burner wall 122 and the tube 124 extending back and partially defining the outer wall of the inner burner. The oxidant passes through two rows 126, 128 of gas injectors which extend radially into the outer burner annular flow channel 120. The gas injectors are fed fuel gas from manifold 131 into which the injectors extend and with which they communicate. Fuel gas to manifold 131 is provided via port 133. Wall 122 is secured to an outer refractory piece 135 by flange 139. Piece 135 essentially functions as a quarl for the outer burner. It has a central opening 137 forming part of flow channel 120.

Gas is fed through a number of injectors in rows 126, 128 which extend along radii. Each radial spud 132 has a series of injection holes which inject the gas normal to the oxidant flow in the same direction as the tangential component provided to the oxidant using the swirl vanes of the inner burner. However, fuel injection opposite to the swirl direction of the inner burner or in both directions simultaneously are also effective means of producing the desired mixing results. The totality of gas injection holes in effect define a grid of injection points, spaced by about 0.25 inches in the radial direction and 0.5 inch in the circumferential direction. The objective is to provide premixed air/FGR/fuel before the outer burner gases are ignited by the combustion gases from the inner burner. The diameter of the holes are based on the rapid mix design disclosed in my prior said applications.

The outer burner gas spuds,shown in FIG. 7, are aligned in two rows in order to generate additional mixing energy in the wake of each row. In the apparatus 100 there are two rows of spuds, each consisting of 20 cylindrical tubes. The tubes in one row are offset 15° from the tubes in the other row. The spuds may be aligned in either a single row or multiple rows. The spuds may take the shape of cylindrical tubes, oval tubes or other fabricated shapes having an minor outside diameter of approximately 0.25 inch. The cross-sectional area of each gas spud is typically at least 3 times the total area of the total injection holes in each spud, to provide uniform gas distribution to each hole.

Figure 9:
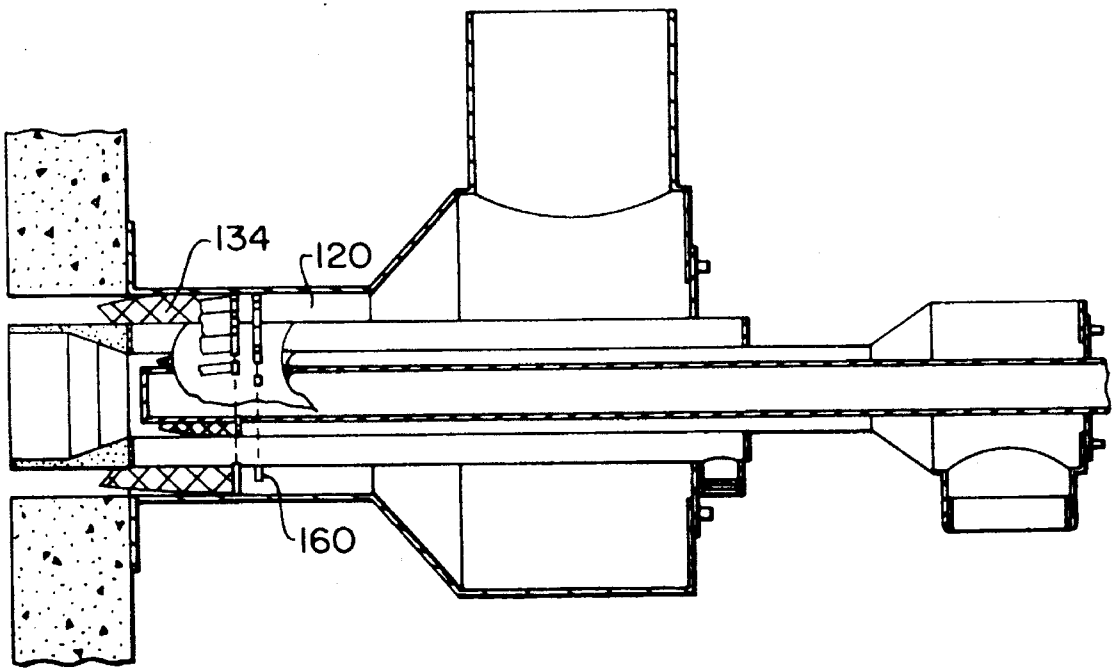
FIG. 9 is a longitudinal cross-sectional view, through a second embodiment of apparatus in accordance with the present invention.
Figure 10:
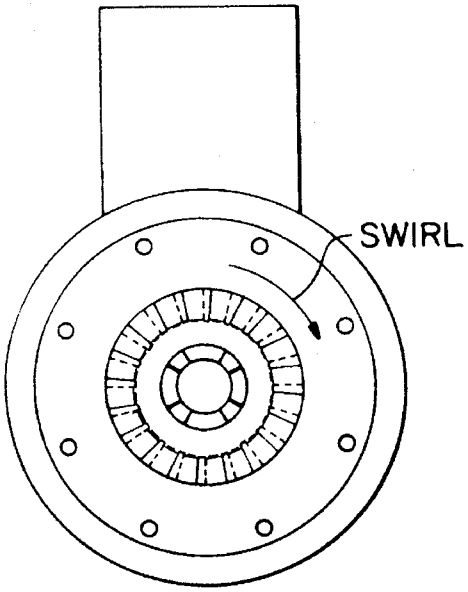
FIG. 10 is a front end view of the FIG. 9 apparatus.

As shown in FIGS. 9 and 10, swirl vanes 134 can be added to the outer annular or flow channel 120. The purpose of the swirl vanes 134 is to accelerate the mixing between the fuel and oxidant. The swirl vanes will also provide a degree of control over the flame shape with a higher swirl level resulting in a shorter, wider flame. Typically swirl vanes with an exit angle of 30 degrees are used, but vanes with exit angles in the range 10 to 50 degrees may be used to control the flame shape. The radial spuds 160 in the embodiment of FIGS. 9 and 10 are oval or flattened tubes, unlike the cylindrical tubes of FIGS. 7 and 8. Within one outer tube diameter downstream of the gas injectors the outer burner flow will enter a refractory section. The refractory will extend downstream, typically ending at the same axial position or extending slightly downstream, of the inner quarl. The refractory section could, however, be replaced with a cylinder formed from the surrounding water wall tubes, if sufficient space is not available in the water wall.

Figure 12:
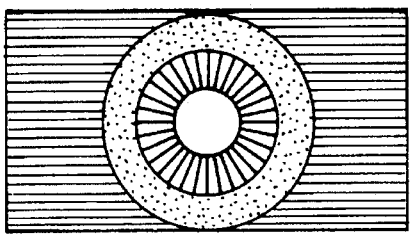
FIG. 12 is an end view of the FIG. 11 apparatus.
Figure 11:
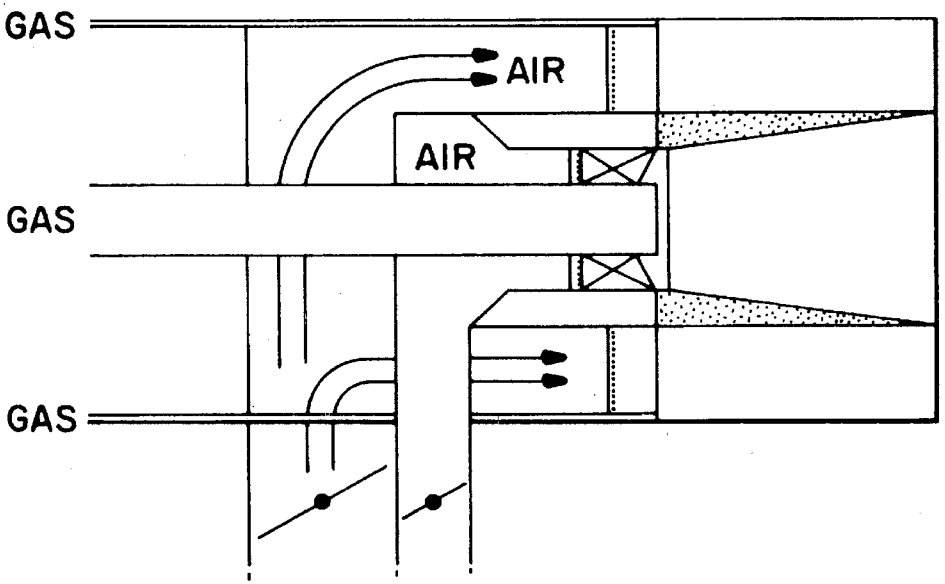
FIG. 11 is a schematic longitudinal cross-sectional view of a two stage apparatus in accordance with the invention, which is provided with a rectangular outer burner portion.
Figure 13:
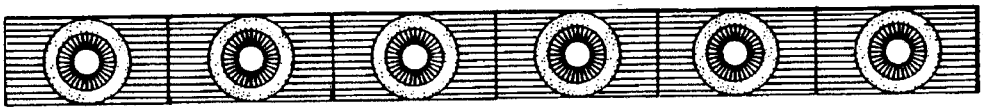
FIG. 13 is a schematic end view of 6 burners as they would appear in one corner of a typical corner fired burner application.

FIGS. 11 and 12 show a two stage RMB having a rectangular outer burner portion. This geometry corresponds to corner (or tangentially fired boilers) which make up a significant fraction of the large industrial and utility boiler market. FIG. 13 also shows a view of 6 burners as they would appear in one corner of a typical corner fired boiler application. The inner burner is conceptually the same as the annular two stage burner described for FIGS. 7 through 10. The quarl of the inner burner has the same outside diameter as the smaller dimension of the rectangular boundary comprising the outer burner.

The gas injection manifold in the outer burner consists of a series of parallel vertical spuds ¼ inch in width and spaced by one inch center to center. Parallel horizontal spuds would be equally effective in generating the desired rapid mixing. The cross-sectional area of each vertical injection spud is large enough to provide uniform gas distribution to each hole in the injector. Typically the cross-sectional area to each spud is at least 3 times the total area of the injection holes. Each spud has a series of holes spaced in ¼ inch increments along its length. The gas injection spuds in the upper and lower burner cells are fed from separate manifolds located near to the upper and lower surface of the outer burner. The gas injection holes may be on either one side of the vertical manifold or on both sides depending on the application.

A screen, perforated plate or other mixing enhancer may be placed downstream of the gas injectors in the outer burner cells, to enhance mixing between the fuel and oxidant.

The objective of the gas distribution system and any screens or perforated plates, located downstream of the gas injection point, is to generate premixed fuel and oxidant upstream of the ignition point.

Experiments were conducted, with a burner having a geometry similar to that shown in FIG. 11, in a 100 hp boiler where 4 MMBtu/hr represents full load. Tests were conducted varying the heat input (load) to the burner over the range 1.5 to 3.5 MMBtu/hr. Tests were also conducted varying the ratio of the heat input to the inner/total burner from 6.6% to 15%. Tests were conducted with both ambient combustion air and 500 F. preheat.

Figure 14:
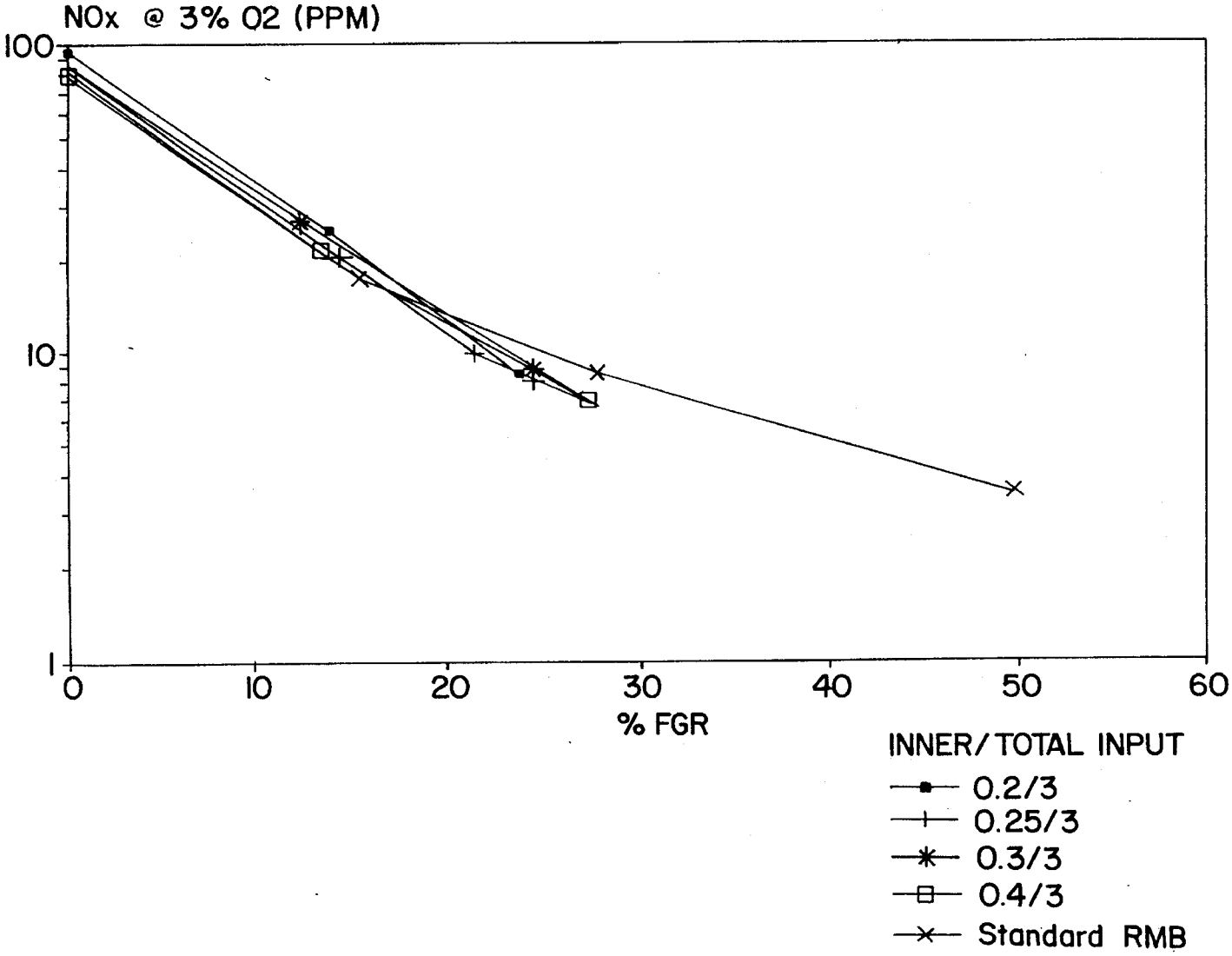
FIG. 14 is a graphical depiction showing the effect of varying the ratio of the inner/total burner heat input as a function of FGR rate with ambient air, and also compares the performance of the rectangular two stage RMB with the basic RMB.
Figure 15:
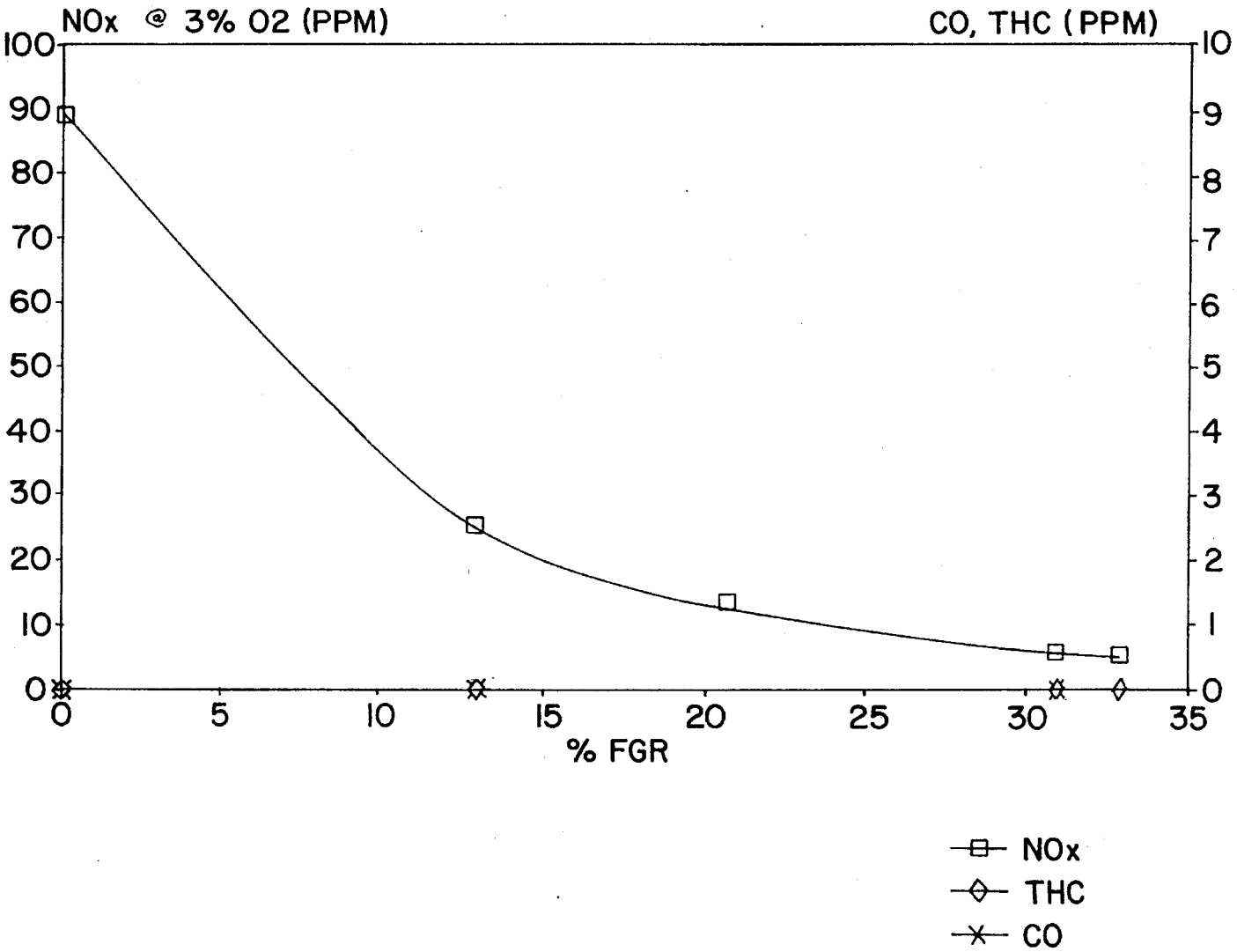
FIG. 15 is a graph showing the CO and total hydrocarbon emissions (THC) as a function of the FGR rate for the two stage burner of the invention.

The results of the tests varying the ratio of the inner/total burner heat input as a function of FGR rate with ambient air are shown in FIG. 14. Burner stability and $NO_x$, at a constant FGR rate, are relatively unaffected by the ratio of the inner to total burner heat input. FIG. 14 also compares the performance of the rectangular two stage RMB burner with the standard RMB. For FGR rates higher than about 20%, the two stage burner has lower $NO_x$ emissions for a given FGR rate than the standard burner. Both the two stage burner and standard RMB are capable of $NO_x$ emissions well below 10 ppm. FIG. 15 shows the CO and total hydrocarbon emissions (THC) as a function of the FGR rate for the two stage burner. When $NO_x$ emissions as low as 5 ppm were achieved, both the CO and THC emissions were below the detection limit of 1 ppm.

Figure 16:
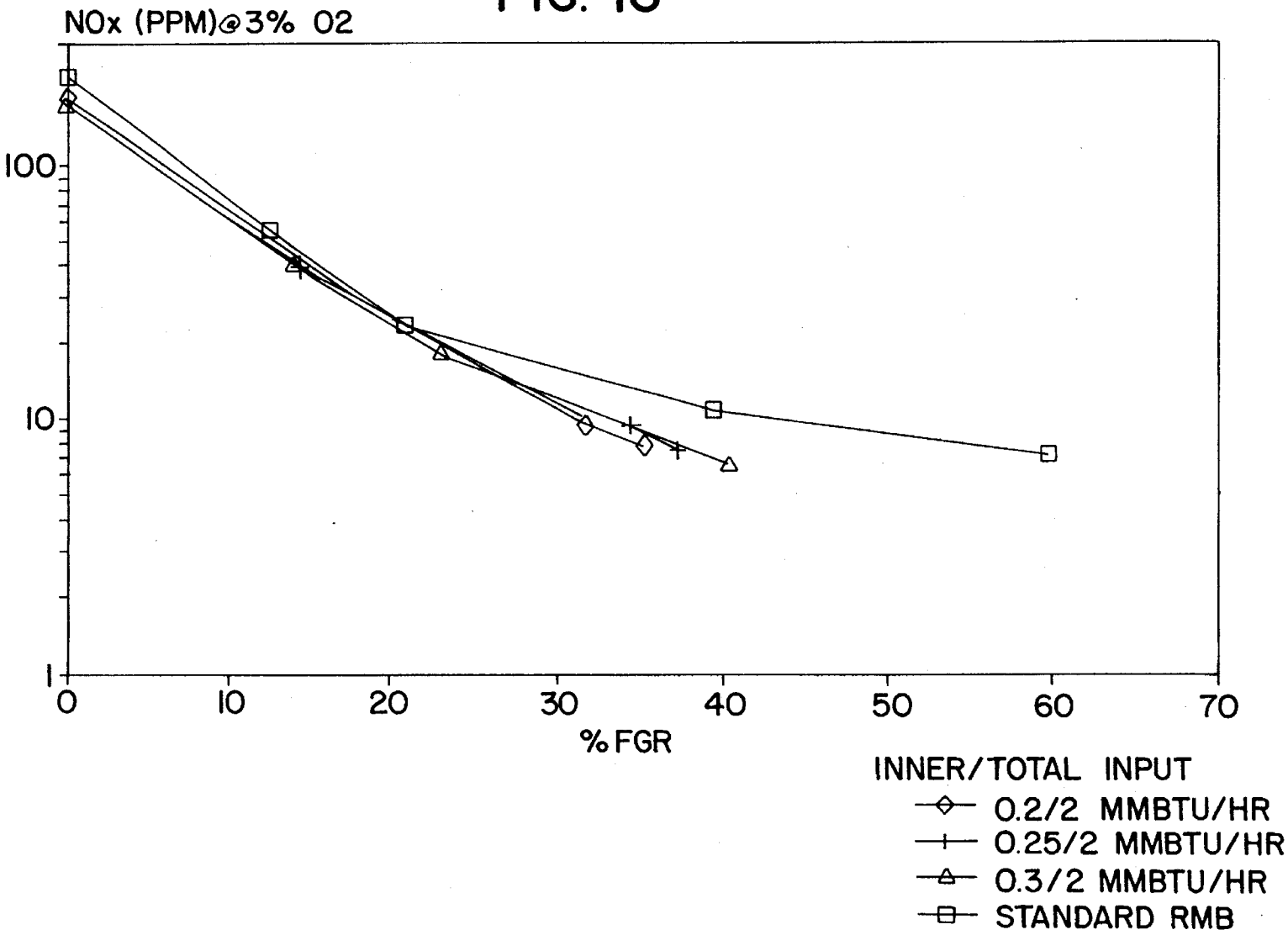
FIG. 16 is a graph comparing the effect of the inner/total burner heat input as a function of FGR rate for 500° F. air preheat.

FIG. 16 compares the effect of the inner/total burner heat input as a function of FGR rate for 500 F. air preheat. Again the $NO_x$ emissions and stability of the two stage burner were not a strong function of the ratio of the heat input ratio between the inner and total burner. For a given FGR rate above about 20%, the $NO_x$ emissions of the two stage burner were lower than for the standard RMB for a given FGR rate.

Figure 17:
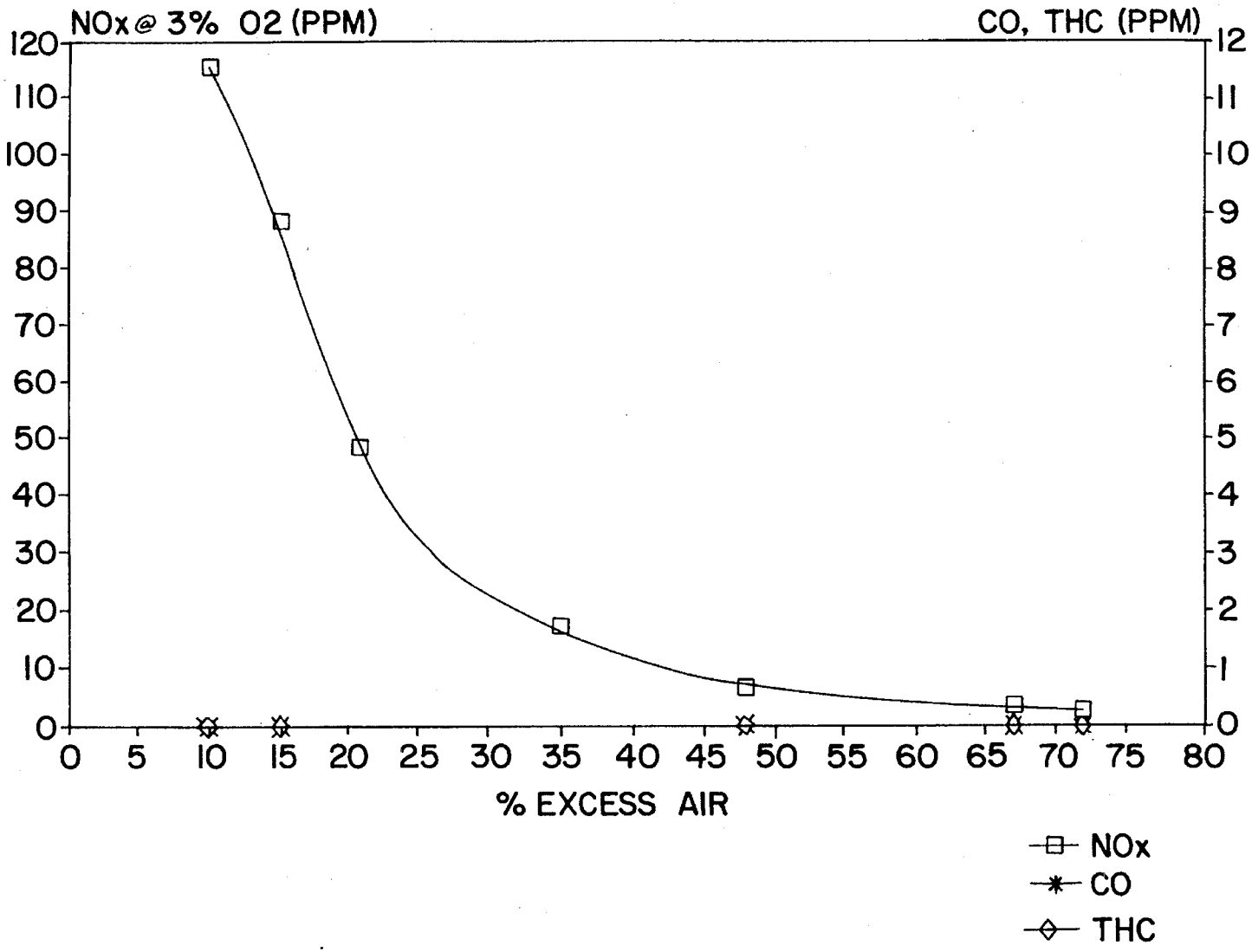
FIG. 17 is a graph illustrating an example of $NO_x$, CO, and THC performance of the invention as a function of excess air levels.
Figure 18:
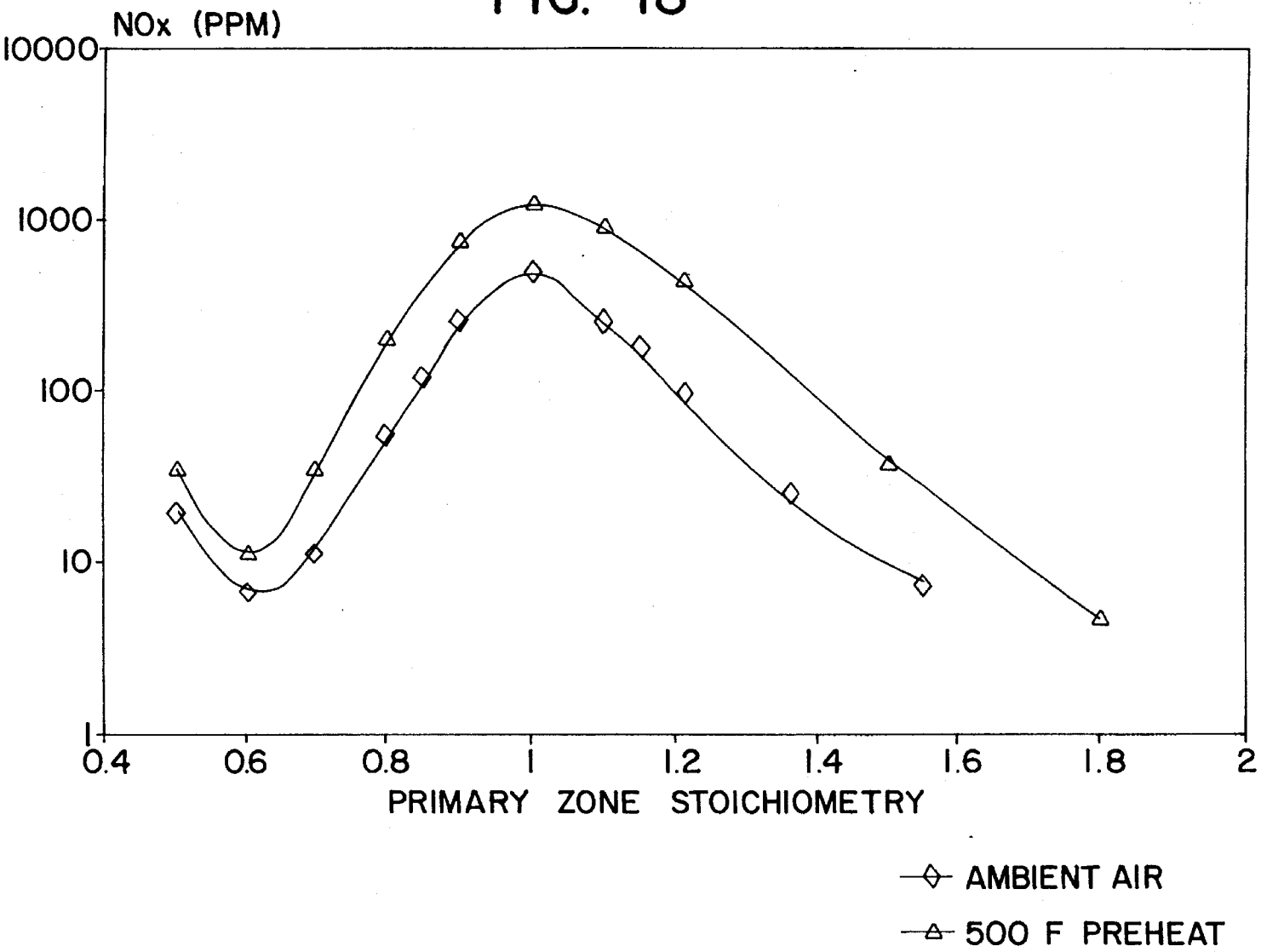
FIG. 18 is a graph showing the performance of a burner in accordance with the invention, calculated from chemical kinetics, as a function of the burner stoichiometry.

The data in FIGS. 17 through 19 demonstrate that the two stage RMB has the capability of reducing $NO_x$ emissions well below 10 ppm with FGR rates less than or equal to those used for the standard RMB. The low $NO_x$ emissions can be maintained with less than 1 ppm CO or THC emissions.

EXAMPLE

To illustrate the reduction in burner size which will result from a two stage design, the following example, comparing the burner diameters for a standard and two stage annular RMB, is given.

Design Criteria

100 MMBtu/hr maximum input 8 inches water pressure drop through burner at full load 500 F. air preheat
500 F. FGR temperature
15% excess air
20% FGR Standard RMB
Throat Diameter=40 inches
Quarl exit diameter (1.5 quarl expansion)=60 inches Two Stage RMB
Inner Burner Quarl outside diameter=20 inches (10 MMBtu/hr)
Outer Burner Diameter=33 inches The two stage burner design will result in a maximum burner diameter of 33 inches compared to the standard RMB maximum diameter of 60 inches for the same burner capacity, FGR rate and pressure drop, with about the same flame stability, $NO_x$, CO and THC emissions. The size reduction occurs primarily for two reasons. First, since the outer burner does not require swirl vanes a higher axial velocity can be used for a given pressure drop. Second, since the flame in the outer burner is stabilized via the inner burner flame a quarl expansion for the outer burner is not required.

The two stage burner RMB can also be operated at high excess air levels to reduce $NO_x$ levels down to extremely low levels in the same manner as the standard RMB. An example of the $NO_x$, CO and THC performance of the RMB as a function of the excess air level in shown in FIG. 17. Excess air is equally effective as FGR in reducing $NO_x$ levels down to below 3 ppm maintaining CO and THC emissions below 1 ppm.

Since the $NO_x$ emissions can be controlled using the RMB equally effectively using excess air or FGR, a multi-burner RMB boiler can operate in what is commonly called a biased fired mode of operation to control $NO_x$ emissions. Biased firing means, in a multi-burner furnace, that some burners operate air rich and others operate fuel rich. FIG. 18 shows the performance of the RMB, calculated from chemical kinetics, as a function of the burner stoichiometry. The data in FIG. 18 shows that even with air preheat, operating one burner near 80% excess air and another burner at a stoichiometry of 0.6 should result in $NO_x$ emissions from both burners less than 10 ppm.

Figure 19:
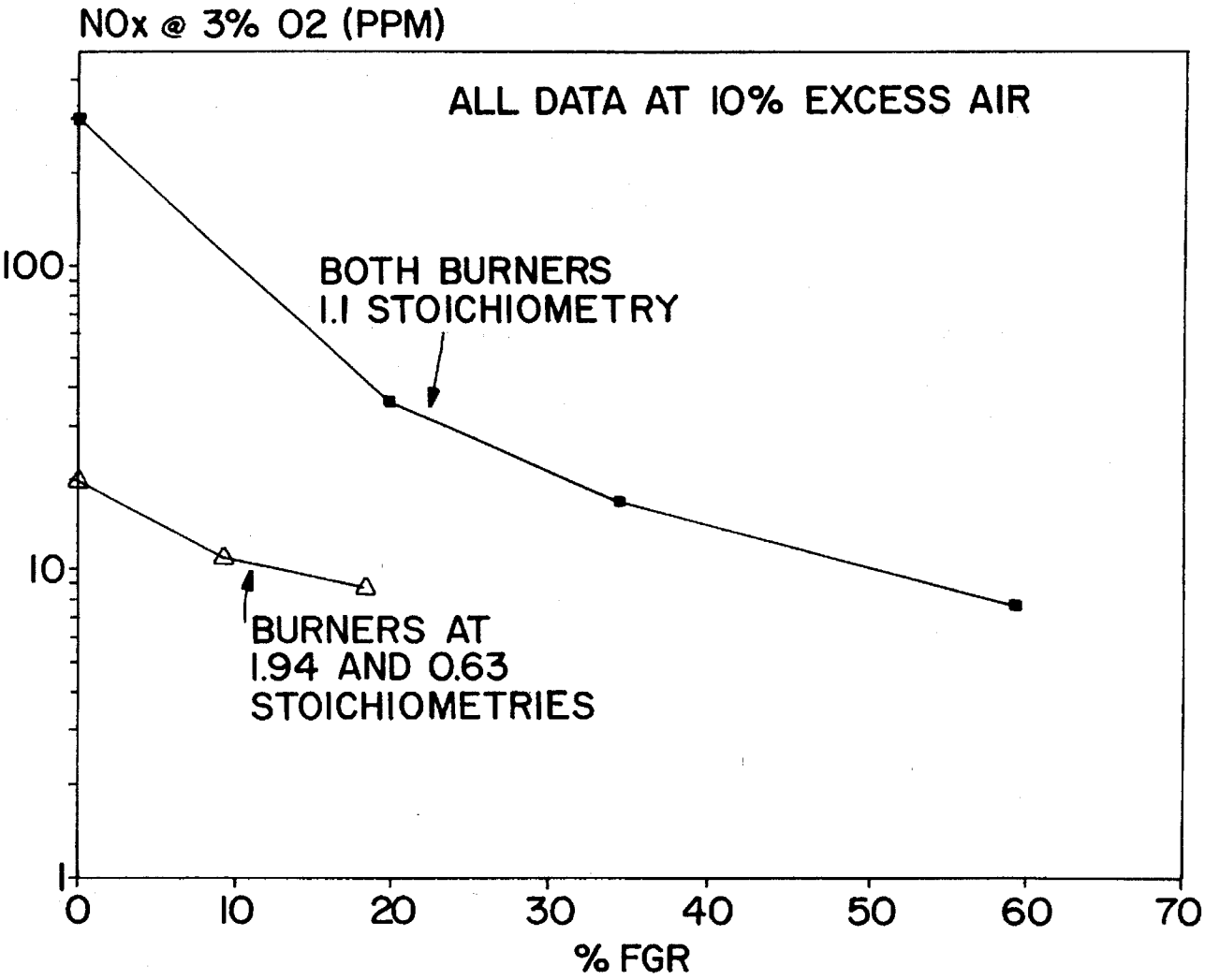
FIG. 19 is a graph comparing measured results operating a two stage burner in accordance with the invention in a biased firing mode with the fuel lean burner operating at 94% excess air and the fuel rich burner at 0.63 stoichiometry, maintaining an overall excess air level of 10%, with the same burners operating at the 10% excess air.

FIG. 19 compares the measured results operating a two burner RMB installation in a biased firing mode, with the fuel lean burner operating at 94% excess air and the fuel rich burner operating at 0.63 stoichiometry, maintaining an overall excess air level of 10% with the same burners both operating at the 10% excess air. The data in the FIG. 9 demonstrate that, without FGR, biased firing results in a reduction in $NO_x$ emissions from 300 ppm to 20 ppm. If FGR is used biased firing reduces the amount of FGR required to achieve 10 ppm $NO_x$ is reduced from 40% to less than 20%.

Although the data shown in FIG. 19 is from a two burner standard RMB operation, the same performance would be expected from a multi-burner two stage RMB operation.

While the present invention has been particular set forth in terms of specific embodiments thereof, it will be understood in view of the present disclosure, that numerous variations on the invention are now enabled to those skilled in the art, which variations yet reside within the scope of the present teaching. Accordingly, the invention is to be broadly construed and limited only by the scope and spirit of the claims now appended hereto.

What is claimed is:

1. A forced draft burner apparatus for burning a gaseous fuel while producing low levels of $NO_x$, CO and hydrocarbon emissions; comprising:

a cylindrical inner burner having a tubular wall;

a generally cylindrical body mounted inside the tubular wall of the inner burner;

an annular flow channel being defined between said body and the inner wall of said tubular section, said channel constituting a throat for oxidant gases, and having a downstream outlet for the inner burner;

means for supplying oxidant gases to said throat of the inner burner;

a divergent quarl for said inner burner having its smaller end connected to said outlet of said inner burner, and exiting into a combustion chamber;

a plurality of curved axial swirl vanes being mounted in said annular flow channel of the inner burner to impart swirl to said oxidant gases flowing downstream in said throat;

inner burner fuel gas injection means for the inner burner being provided in said annular channel proximate to said swirl vanes for injecting said gas into the flow of oxidant gases at a point upstream of said outlet end in a manner that results in uniform mixing of the fuel and oxidant upstream of the ignition point;

said fuel gas injection means for said inner burner comprising a plurality of spaced gas injectors each being defined by a gas injection hole and means to feed the gas thereto; the ratio of the number of gas injection holes to the transverse cross-sectional area of the annular flow channel of the inner burner being at least $200/ft^2$;

an outer burner surrounding at least a portion of said inner burner and including a wall spaced from the outer wall of the inner burner to define an outer burner flow channel having a downstream outlet end for gases provided to said channel;

means for providing a flow of oxidant into the outer burner flow channel; and outer burner fuel gas injection means for the outer burner being provided in said outer burner flow channel, upstream of the outer burner outlet end, comprising a plurality of spaced gas injectors, each being defined by a gas ejection hole and means to feed the gas thereto; the ratio of the number of gas injection holes to the transverse cross-sectional area of the flow channel of said outer burner being at least $200/ft^2$.

2. Apparatus in accordance with claim 1, wherein said outer burner is of rectangular cross-section.

3. Apparatus in accordance with claim 1, wherein said outer burner is of cylindrical cross-section.

4. Apparatus in accordance with claim 1, wherein said outer burner is of irregular cross-section.

5. Apparatus in accordance with claim 1, wherein a means are provided to premix recirculated flue gases into the combustion air for both the inner and outer burners.

6. Apparatus in accordance with claim 1, where the heat input ratio of the inner/outer burner at full load is in the range of 5% to 20%.

7. Apparatus in accordance with claim 1, wherein the product of the swirl number and quarl inlet to outlet number for the inner burner is in the range 1.0 to 3.0.

8. Apparatus in accordance with claim 1, wherein the ratio of the inner diameter to the outer diameter of the inner burner swirl vanes is in the range 0.6 to 0.8.

9. Apparatus in accordance with claim 1, wherein turbulence enhancing means are provided in the outer burner to promote fine scale turbulence into the flow and generate microscale mixing between the fuel and oxidant prior to combustion.

10. Apparatus in accordance with claim 8, wherein swirl vanes are provided in the outer burner flow channel to promote mixing and control flame shape.

11. Apparatus in accordance with claim 8, wherein screens or perforated plates are provided in said annular flow channel to promote microscale mixing.

12. Apparatus in accordance with claim 1, having an inner burner quarl length to inlet diameter ratio of 1.75 or greater, with a quarl outlet to inlet diameter ratio of approximately 1.5.

13. Apparatus in accordance with claim 1, in which said inner burner gas injectors are located at the leading edge of said swirl vanes and inject said fuel gas counter-current, co-current or both counter-current and co-current to the direction of the tangential component of the flow imparted by the swirl vanes of the inner burner.

14. Apparatus in accordance with claim 1, in which said inner burner gas injectors are located at the trailing edge of said swirl vanes and inject said fuel gas counter-current, co-current or both counter-current and co-current to the direction of the tangential component of the flow imparted by the swirl vanes of the inner burner.

15. Apparatus in accordance with claim 1, in which inner burner gas injectors are disposed on a plurality of hollow concentric rings which are mounted in said throat proximate to the swirl vanes of the inner burner.

16. Apparatus in accordance with claim 15, comprising at least two spaced rings, the holes on the outer ring facing toward the axis of said conduit and the holes on the inner ring facing away from said axis, whereby to produce a flow of gas from each ring toward each other.

17. Apparatus in accordance with claim 1, wherein said outer burner fuel gas injection means comprise gas spuds along the radii of the outer burner with injection holes being oriented to eject fuel gas counter-current, co-current or both counter-current and co-current to the direction of swirl of the inner burner.

18. Apparatus in accordance with claim 1, wherein said outer burner fuel gas injection means comprise multiple rows of gas spuds, at more than one axial position, along the radii of an annular outer burner with injection holes being oriented to eject fuel gas counter-current, co-current, or both counter-current and co-current to the direction of swirl of the inner burner.

19. Apparatus in accordance with claim 1, having gas injectors parallel to one or more sides of a rectangular outer burner.

20. Apparatus in accordance with claim 1, wherein said generally cylindrical body spaced inwardly from said tubular section includes a liquid fuel injector means, which thereby provides the burner both gas and liquid fuel firing capabilities.

21. Apparatus in accordance with claim 20, wherein said liquid injector comprises a liquid feed tube extending along the axis of said generally cylindrical body; and a nozzle from the end of said tube extending from the outlet end of said throat, a hollow cylinder surrounding said tube and being open at the end toward said nozzle; and said apparatus including means for diverting air from said windbox to said hollow cylinder to provide an air stream preventing coke and ash particles from depositing on the liquid gun during liquid firing.

22. Apparatus in accordance with claim 1, wherein the geometry of one or more of the outer burners corresponds to the standard burner openings of a corner fired boiler.

* * * * *